US011383352B2

(12) United States Patent
Valentini

(10) Patent No.: US 11,383,352 B2
(45) Date of Patent: Jul. 12, 2022

(54) POLISHING PAD

(71) Applicant: Guido Valentini, Milan (IT)

(72) Inventor: Guido Valentini, Milan (IT)

( * ) Notice: Subject to any disclaimer, the term of this patent is extended or adjusted under 35 U.S.C. 154(b) by 252 days.

(21) Appl. No.: 16/919,818

(22) Filed: Jul. 2, 2020

(65) Prior Publication Data

US 2020/0331119 A1 Oct. 22, 2020

Related U.S. Application Data

(62) Division of application No. 14/508,328, filed on Oct. 7, 2014, now Pat. No. 10,786,884.

(30) Foreign Application Priority Data

Oct. 8, 2013 (EP) ..... 13187675

(51) Int. Cl.
*B24D 11/02* (2006.01)
*B24D 13/14* (2006.01)
(Continued)

(52) U.S. Cl.
CPC ..... *B24D 7/18* (2013.01); *B24B 23/03* (2013.01); *B24B 37/22* (2013.01); *B24B 37/24* (2013.01);
(Continued)

(58) Field of Classification Search
CPC . B24D 3/00; B24D 3/002; B24D 7/18; B24D 11/001; B24D 11/005;
(Continued)

(56) References Cited

U.S. PATENT DOCUMENTS 3,143,770 A 8/1964 Jeske
4,631,220 A 12/1986 Clifton
(Continued)

FOREIGN PATENT DOCUMENTS

CN 1675063 A 9/2005
CN 101511542 A 8/2009
(Continued)

OTHER PUBLICATIONS

Mar. 3, 2014 European Search Report for European Application No. 13 18 7675.
(Continued)

*Primary Examiner* — Eileen P Morgan
(74) *Attorney, Agent, or Firm* — Howard & Howard Attorneys PLLC

(57) ABSTRACT

A polishing pad including a damping layer made of a resilient material including expanded semi-rigid polyurethane having a microcell structure, an adhesive layer including a layer of a hook-and-loop fastener adapted to interact and connect to a corresponding layer of the hook-and-loop fastener located at a bottom surface of the working element of the machine tool and a polishing layer including microfiber adapted for polishing a surface of a work piece. The polishing layer includes a fabric having a woven mesh of microfibers that define a back side of the polishing layer. The fabric serves as a barrier to the resilient material of the damping layer such that the resilient material does not reach an active side of the polishing layer comprising the microfibers when the damping layer, adhesive layer and polishing layer are combined, and such that the active side of the polishing layer is free of resilient material of the damping layer.

8 Claims, 5 Drawing Sheets

(51) Int. Cl.

| | |
|---|---|
| ***B24B 23/02*** | (2006.01) |
| ***B24B 37/22*** | (2012.01) |
| ***B24B 37/24*** | (2012.01) |
| ***B24D 7/18*** | (2006.01) |
| ***B24D 18/00*** | (2006.01) |
| ***B24B 23/03*** | (2006.01) |
| ***B24D 3/00*** | (2006.01) |

(52) U.S. Cl.
CPC ..... *B24D 3/002* (2013.01); *B24D 11/02* (2013.01); *B24D 13/142* (2013.01); *B24D 13/147* (2013.01); *B24D 18/0009* (2013.01)

(58) Field of Classification Search
CPC ..... B24D 11/006; B24D 11/02; B24D 13/14; B24D 13/142; B24D 13/147; B24D 18/0009; B24D 18/009; B24B 23/02; B24B 23/03; B24B 37/20; B24B 37/22; B24B 37/24
USPC ..... 451/357, 359, 526, 530, 533, 539
See application file for complete search history.

(56) References Cited

U.S. PATENT DOCUMENTS

| | | | | |
|---|---|---|---|---|
| 4,844,967 | A | 7/1989 | Goralski et al. | |
| 5,105,585 | A | 4/1992 | Hampl et al. | |
| 5,123,139 | A | 6/1992 | Leppert et al. | |
| 5,375,289 | A | 12/1994 | Miyaoka | |
| 5,807,161 | A * | 9/1998 | Manor | B24D 15/04 451/529 |
| 7,972,396 | B2 | 7/2011 | Feng et al. | |
| 2004/0010878 | A1 | 1/2004 | Levesque | |
| 2004/0137831 | A1* | 7/2004 | Kollodge | B24B 37/22 451/41 |
| 2004/0157985 | A1 | 8/2004 | Masui et al. | |
| 2004/0166282 | A1 | 8/2004 | Kingsford et al. | |
| 2005/0060829 | A1 | 3/2005 | Silvers et al. | |
| 2007/0079470 | A1 | 4/2007 | Rippl et al. | |
| 2008/0053000 | A1 | 3/2008 | Palmgren et al. | |
| 2008/0216272 | A1 | 9/2008 | McLain | |
| 2010/0015900 | A1 | 1/2010 | Valentini | |
| 2013/0102231 | A1 | 4/2013 | Joseph et al. | |
| 2014/0325781 | A1 | 11/2014 | Sauzek | |
| 2015/0099439 | A1 | 4/2015 | Feng et al. | |
| 2016/0158920 | A1* | 6/2016 | Valentini | B24B 55/102 451/490 |

FOREIGN PATENT DOCUMENTS

| | | | |
|---|---|---|---|
| CN | 102686361 | A | 9/2012 |
| EP | 0 925 317 | A1 | 6/1999 |
| WO | 03103959 | A1 | 12/2003 |

OTHER PUBLICATIONS

First Chinese Office Action dated Dec. 29, 2016 issued by the State Intellectual Property Office of People's Republic of China for Chinese Application No. 201410522268.1.

* cited by examiner

POLISHING PAD

CROSS-REFERENCE TO RELATED APPLICATIONS

This application is a divisional of U.S. patent application Ser. No. 14/508,328, filed on Oct. 7, 2014, which is based upon and claims priority to European Patent Application No. 13187675.7-1702, filed on Oct. 8, 2013.

BACKGROUND OF THE INVENTION

1. Field of the Invention

The present invention relates, generally, to polishing pads.

2. Description of the Related Art

Conventional polishing pads for hand-guided electric or pneumatic machine tools with a working element performing an orbital, random orbital, and/or a rotational movement are well known in the art. Polishing pads are typically used use with a grinder, a polisher, or a sander. Polishing pads have a plurality of layers that are inseparably attached to one another, the layers include: a damping layer made of a resilient material, an adhesive layer for connecting to a corresponding layer located at a bottom surface of the working element of the machine tool, and a polishing layer with microfiber for polishing a surface of a work piece.

Polishing pads are used for polishing surfaces, in particular varnished surfaces of a motor vehicle body, of a boat, or the like. The polishing pad is attached to the bottom surface of a working element of a hand guided electrically or pneumatically driven machine tool. An electric machine tool can be driven with the electric energy taken from a power supply network or from a battery, in particular a rechargeable battery integrated into the tool. The working element can perform a high speed orbital, random orbital, and/or a rotational movement thereby moving the attached polishing pad in the same way with respect to the surface to be polished. In order to increase the polishing effect, a polishing paste may be applied to the surface to be polished, so that the polishing pad smoothly rubs the paste into the surface.

By way of example, a grinder can rotate the working element at a speed up to 30,000 rotations per minute (RPM). A polisher or sander will usually rotate the working element at a lower speed of up to 3,000 RPM. Orbital and random orbital sanders typically move the working element at approximately up to 15,000 RPM. Planetary sanders can move the working element at an even lower speed of approximately 500-700 RPM. It will be appreciated that all of the above-identified tools can work at any lower speed, too, when used for polishing surfaces with a polishing pad. A good speed for polishing surfaces is around 300-2,500 RPM.

Conventional polishing pads include a damping layer made of a resilient material, in particular of an expanded polyurethane material with sponge-like characteristics. The damping layer allows even and smooth force distribution from the working element onto the surface to be polished. The damping layer typically has a disk-like shape and may have a thickness of approximately 1-3 cm. An adhesive layer is attached to one surface of the damping layer. The adhesive layer is adapted for connection to a corresponding layer located at a bottom surface of the working element of the machine tool. In particular, the adhesive layer includes a layer of a hook-and-loop fastener adapted to interact with a corresponding layer of the hook-and-loop fastener located at the bottom surface of the working element. The hook-and-loop fastener is also known as Velcro®. A polishing layer is attached to the other surface of the damping layer opposite to the surface carrying the adhesive layer. The polishing layer is in contact with the surface to be polished when the tool is in its intended use. The polishing layer is made of a particularly smooth and soft material, which can hold, evenly distribute, and rub a polishing paste or similar into the surface to be polished. In particular, the polishing layer includes a synthetic fiber having a linear mass density of 2.0 denier or less, preferably of 1.3 denier or less, particularly preferred of 1.0 denier or less (corresponding to approximately 0.222 Tex, 0.1443 Tex, and 0.111 Tex, respectively). The polishing layer can be made of Silicon or any other suitable kind of plastic material, lamb's wool, or microfiber. The most common types of microfibers are made from polyesters, polyamides (e.g., Nylon®, Kevlar®, Nomex®, Trogamid®), or a conjugation of polyester, polyamide and polypropylene (Prolene).

In manufacturing conventional polishing pads, the damping layer is die-cut out of a large material layer of expanded polyurethane. The adhesive layer and the polishing layer are simply glued to opposite surfaces of the damping layer. Even though gluing has made considerable progress recently, the glued connection between the adhesive layer and the damping layer on the one side and between the polishing layer and the damping layer on the other side cannot withstand the high demand in terms of stress, load, and wear applied to the polishing pad during the polishing process for a longer period of time. One reason for the insufficient gluing connection between the various layers of the polishing pad is that the foamed material of the damping layer includes many embedded air bubbles, which lead to a significant reduction of the active surface of the damping layer actually participating at the gluing connection. The glue only sticks on the outer surface regions of the damping layer and does not enter into the air bubbles located on the surface. Thus, the active surface of the damping layer actively participating at the gluing connection is approximately only ⅓ to ½ of the overall surface.

Conventional polishing pads have to be replaced frequently because either the adhesive layer or the polishing layer detaches itself from the damping layer, or the foamed material of the damping layer disintegrates along the outer border of the damping layer. Because of this, the user of the polishing machine tool has high expenses for polishing pads which do not last long and consequently have to be replaced frequently.

Thus, there remains a need in the art for a polishing pad which can better withstand the high demand in terms of stress, load, and wear applied to the polishing pad during the polishing process for a longer period of time.

SUMMARY OF THE INVENTION

The present invention overcomes the disadvantages in the related art in a polishing pad in which the layers of the polishing pad are attached to one another via a molding process during manufacturing of the polishing pad. Advantageously, the resilient material is polyurethane, preferably a semi-rigid polyurethane with microcells.

The adhesive layer may include a layer of a hook-and-loop fastener adapted to interact with a corresponding layer of the hook-and-loop fastener located at the bottom surface of the working element. Preferably, the adhesive layer includes a layer of loops adapted to interact with a layer of hooks located at the bottom surface of the working element, and the polishing layer includes a microfiber, in particular a hydrophobic microfiber.

It is further suggested that the polishing pad has an essentially circular form. More specifically, the polishing pad advantageously has the form of a truncated cone, whereby polishing pad's top surface carrying the adhesive layer has a smaller diameter than the polishing pad's bottom surface carrying the polishing layer. A peripheral surface connecting the top surface and the bottom surface has an angle in respect to the bottom surface within a range of 15° to 70°. The peripheral surface can be planar or curved. With a planar peripheral surface, the angle between the peripheral surface and the bottom surface has the same value along the entire peripheral surface. With a peripheral surface curved to the inside, the angle between the peripheral surface and the bottom surface increases starting from the bottom surface and along the peripheral surface to the top surface. With a peripheral surface curved to the outside, the angle between the peripheral surface and the bottom surface has a decreasing value starting from the bottom surface and going along the peripheral surface to the top surface.

The truncated cone form of the polishing pad has the advantage that the polishing pad can be easily extracted from the casting mold after the manufacturing process, if the lid of the casting mold opens on that side of the polishing pad which has the larger diameter. Moreover, the circumferential border of the polishing pad is thin at the outside and slowly becomes thicker towards the center of the polishing pad, making the external rim of the polishing pad more resilient than those parts of the polishing pad located more towards the center. Thus, when using the polishing pad along edges or in angles of the surface to be polished, the external rim of the polishing pad can easily adapt its form to the edge or angle.

The polishing pad of the present invention that may be manufactured by providing a casting mold having a recess essentially corresponding to the overall form of the polishing pad and a lid for closing the recess. An adhesive layer or the polishing layer is placed into the recess at the bottom of the casting mold. Resilient material for the damping layer is poured into the recess of the casting mold on top of the adhesive layer or the polishing layer, respectively. The polishing layer or the adhesive layer, respectively, is placed on top of the resilient material. The recess with the lid of the casting mold is closed. External heat is then supplied to the polishing pad until the resilient material of the damping layer is cured.

It is suggested to manufacture the polishing plate and, in particular, to attach the adhesive layer and the polishing layer to the damping layer via a molding process. For example, the adhesive layer can be placed face down at the bottom of the recess of the casting mold. Then, the resilient material for the damping layer can be poured or injected into the recess on top of the adhesive layer. The material can be poured into the recess either because its compounds (of which at least one is fluid-like, semi-liquid, or viscous) have just been combined and have not yet reacted, or because the material is thermally treated (in particular, heated), giving the material a fluid-like, semi-liquid, or viscous characteristic. Then, the polishing layer can be placed face up on top of the resilient material of the damping layer. Next, the recess of the casting mold can be closed by placing the lid on top of or in an opening of the recess.

The material of the damping layer is preferably a polyurethane, in particular a semi-rigid polyurethane having microcells, for example like the material known from EP 0925317A1. Such a polyurethane material has improved resistance against stress, load, and wear applied to the polishing pad during the polishing process. In particular, the damping material is not disintegrated as easily as conventional foamed material.

The polishing layer could be placed on top of the resilient material together with the lid. In that case, the polishing material is previously attached to the inside of the lid. It will be appreciated that it is also possible to initially place the polishing layer face down at the bottom of the recess of the casting mold. Then, after the resilient material of the damping layer has been poured or injected into the recess on top of the polishing layer, the adhesive layer is placed face up on top of the resilient material. In that case, the adhesive layer could be placed on top of the resilient material together with the lid, in which case the adhesive layer is previously attached to the lid.

The adhesive layer and/or the polishing layer may each include a fabric having a mesh with a predetermined tightness. The term "tightness" refers to the mutual distance between the fibers or threads of the mesh. By placing the lid on the recess a certain degree of pressure is exerted on the three layers located in the recess of the casting mold. In particular, the adhesive layer and the polishing layer can be pressed with their back face into the still fluid-like, semi-liquid, or viscous resilient material of the damping layer, thereby urging some of the resilient material to at least partly enter into the mesh between the fibers or threads. This provides for an extremely strong connection between the adhesive layer and the damping layer on the one side and the polishing layer and the damping layer on the other side after the resilient material of the damping layer has cured.

In one embodiment, the mesh of the adhesive layer and/or of the polishing layer is tight enough that is the mutual distance between the fibers or threads of the mesh is small enough to impede the resilient material of the damping layer to pass through the fabric when poured into the recess of the casting mold. This has the advantage that no resilient material of the damping layer reaches the front face of the adhesive layer and of the polishing layer. Such resilient material on the front face of the polishing layer would severely affect the polishing capabilities of the polishing layer. However, resilient material reaching the front face of the adhesive layer could affect a proper attachment of the polishing pad to the bottom surface of the working element. For example, the resilient material could enter hooks or loops of the adhesive layer, thereby inactivating them such that they can no longer participate at the hook-and-loop connection between the adhesive layer and a corresponding layer at the bottom surface of the working element.

It is further suggested that the amount of the resilient material of the damping layer poured into the recess is defined such that the resilient material together with the adhesive layer and the polishing layer, in any event, fills out the recess when closed with the lid. Advantageously, the amount of resilient material selected is slightly more than actually needed, in order to ensure that, in any event, the recess is completely filled out with the adhesive layer, the polishing layer, and the damping layer. The superfluous resilient material could be squeezed out of the casting mold when the lid is pressed onto or into the recess.

In one embodiment, the casting mold is made of a thermally conductive material, in particular of metal, and the casting mold is heated so as to convey at least part of the applied heat to the recess and the layers located therein during manufacturing of the polishing pad. By applying a defined amount of heat over time, the curing of the resilient material of the damping layer can be controlled in order to give the damping layer the desired characteristics.

BRIEF DESCRIPTION OF THE DRAWINGS

Other objects, includes, and advantages of the present invention will be readily appreciated as the same becomes better understood after reading the subsequent description taken in connection with the accompanying drawing wherein:

FIG. 1 shows a hand guided machine tool that a polishing pad according to the present invention is adapted to be used with.

DETAILED DESCRIPTION OF THE INVENTION

Figure 1:
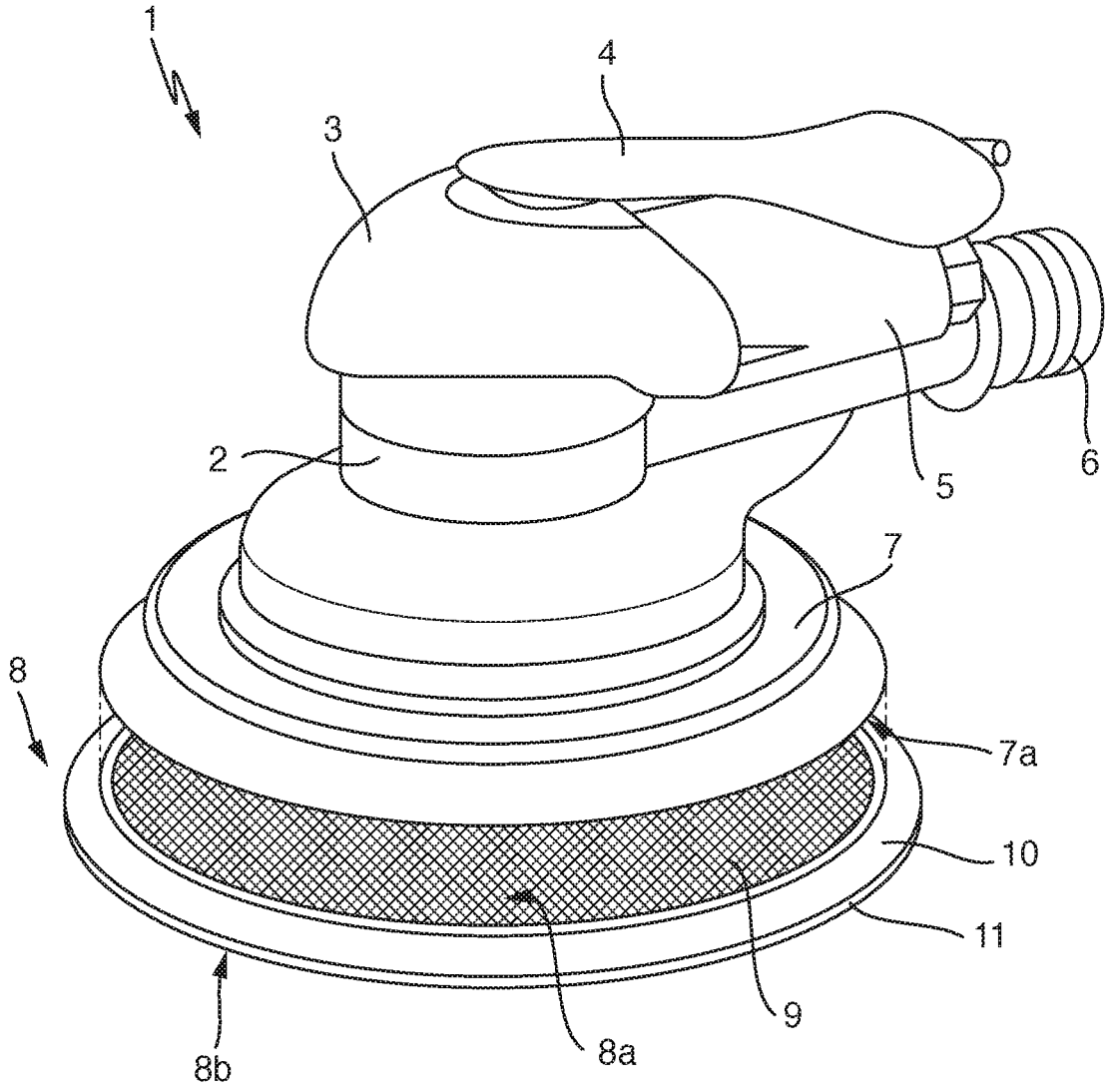

With reference now to the drawings, FIG. 1 shows a hand-guided machine tool 1 adapted to be used with a polishing pad according to the present invention. In the embodiment of FIG. 1, the tool 1 is a pneumatically-driven random orbital sander with dust extraction. The tool 1 includes a casing 2, preferably made of plastic or metal. On top of the casing 2, a grip member 3 is disposed and is designed to allow a user of the tool 1 to comfortably and safely hold the tool 1 during use. Furthermore, the tool 1 has a switch lever 4 on top of the grip member 3. A hose for compressed air can be attached to connection element 5. Finally, another connection element 6 is adapted for connection to a hose of a vacuum cleaner or of any other kind of dust suction device.

Inside the casing 2, the tool 1 includes a pneumatic motor driven by compressed air from the connection element 5. The tool 1 also includes a plate-like working element 7 made of a rigid material and adapted for receiving and holding a polishing pad 8. The tool's motor and the working element 7 are in connection with one another, preferably via a gear mechanism (such as an eccentric set) for transforming the motor's rotation into a random orbital movement of the working element 7. The polishing pad 8 is removably attached to a bottom surface 7*a* of the working element 7, in order to allow fast and easy replacement of the polishing pad 8 if necessary or desired. To that end, a top surface 8*a* of the polishing plate 8 is provided with an adhesive layer 9 adapted for connection to a corresponding layer located at the bottom surface 7*a* of the working element 7 of the machine tool 1. The removable attachment of the polishing pad 8 to the working element 7 can be achieved, for example, by a hook-and-loop fastener. To that end, the adhesive layer 9 can be provided with a plurality of hooks and the corresponding layer on the bottom surface 7*a* of the working element 7 can be provided with a plurality of corresponding loops. Similarly, the adhesive layer 9 can be provided with a plurality of loops and the corresponding layer on the bottom surface 7*a* can be provided with a plurality of corresponding hooks.

Although the tool 1 shown in FIG. 1 is a pneumatically driven random orbital sander, it will be appreciated that the polishing pad of the present invention is adapted to be used with any kind of electronically or pneumatically driven hand-guided machine tool having a working element performing an orbital, random orbital, and/or a rotational movement. In particular, the polishing pad is adapted for use with any kind of grinder, polisher, or sander, with or without dust extraction features.

The polishing pad 8 includes a plurality of layers that are inseparably attached to one another. The layers include: a damping layer 10 made of a resilient material, for example expanded or foamed polyurethane; an adhesive layer 9 adapted for connection to a corresponding layer located at the bottom surface 7*a* of the working element 7; and a polishing layer 11 of synthetic microfiber having a mass density of preferably 1.0 denier or less, adapted for polishing a surface of a work piece.

Conventionally, the various layers 9, 10, 11 of the polishing pad 8 are glued together. In particular, for manufacturing conventional polishing pads 8 the damping layer 10 is die-cut out of a large material layer of foamed or expanded polyurethane. Then the adhesive layer 9 and the polishing layer 11 are glued to opposite surfaces 8*a*, 8*b* of the damping layer 10.

Figure 2:
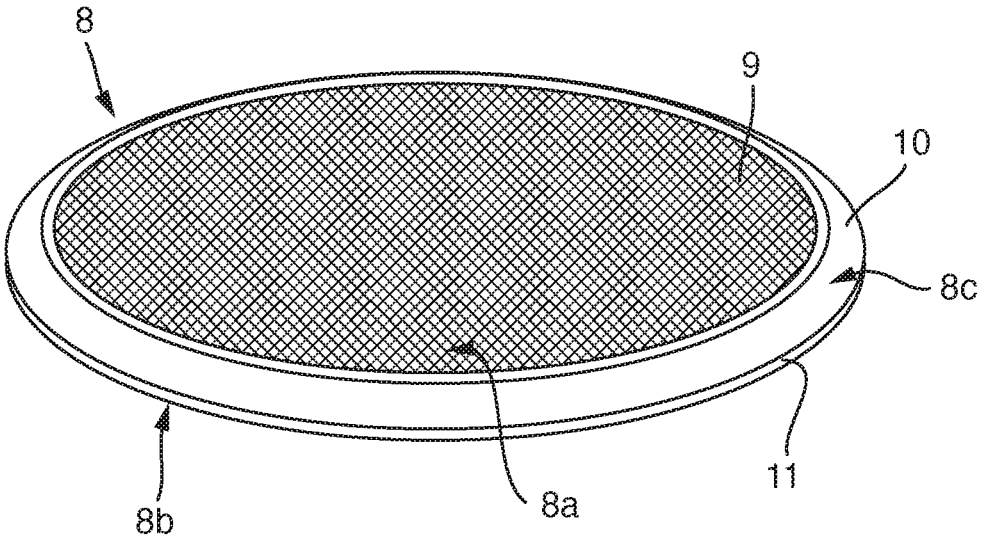
FIG. 2 is a perspective view of a polishing pad according to one embodiment of the present invention.
Figure 3:
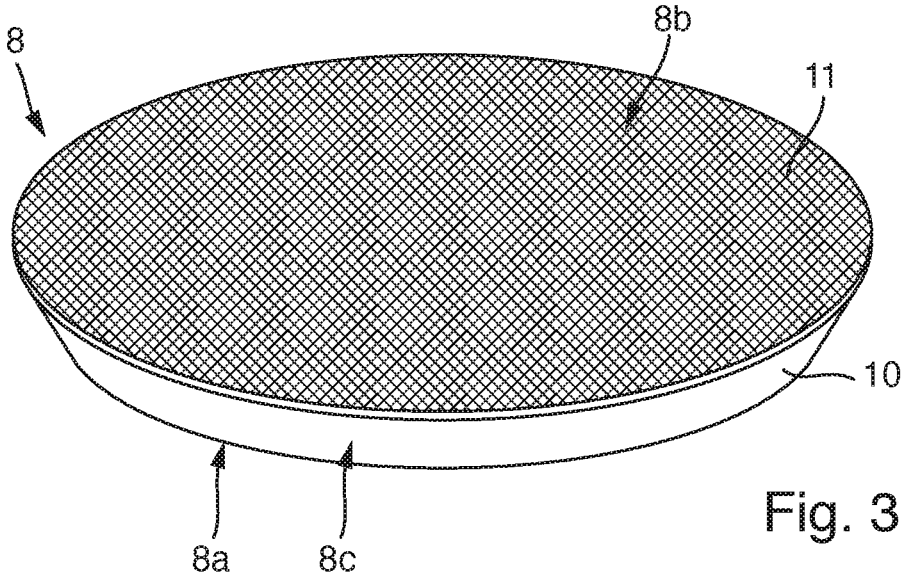
FIG. 3 is an alternate perspective view of the polishing pad of FIG. 2.
Figure 4:
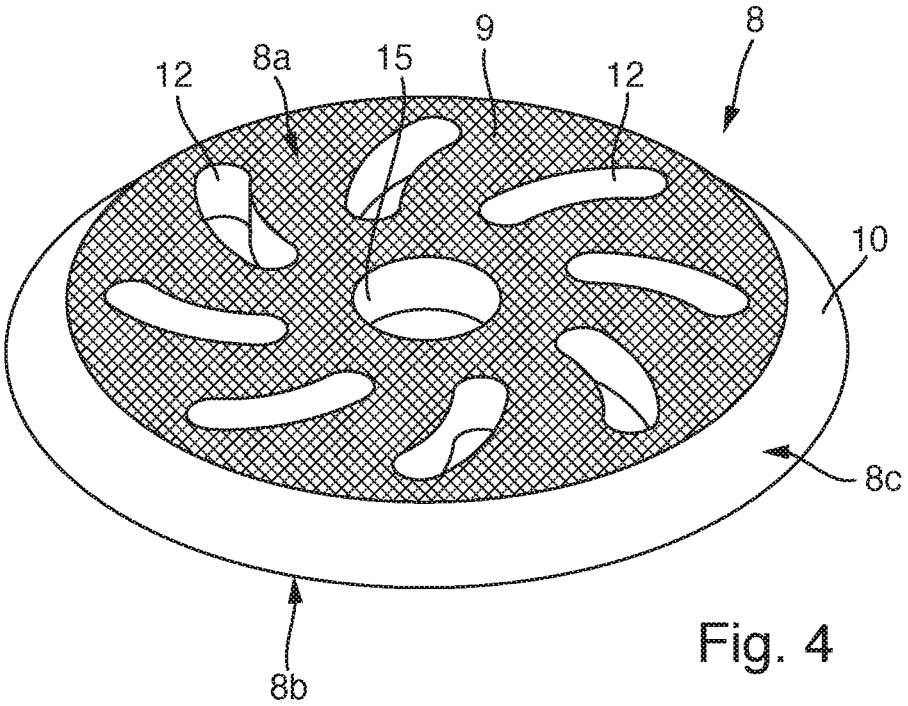
FIG. 4 is a perspective view of a polishing pad according to another embodiment of the invention.
Figure 5:
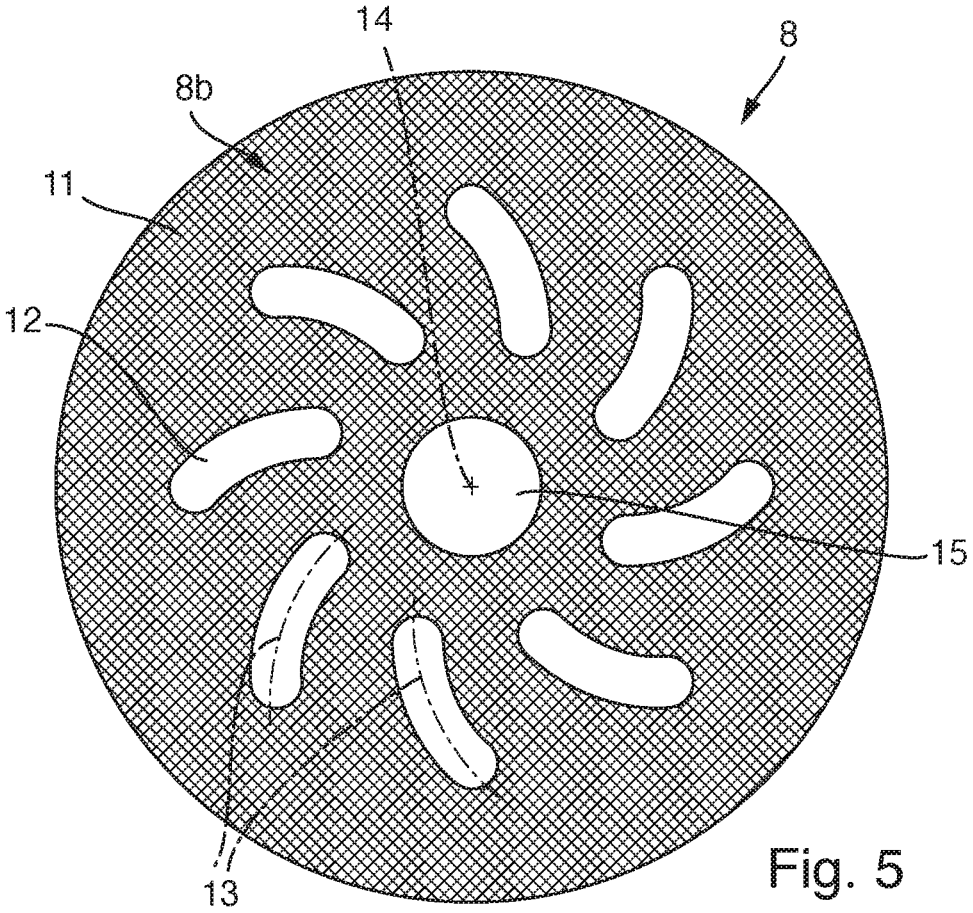
FIG. 5 is a bottom side plan view of the polishing pad of FIG. 4.

According to the present invention, the adhesive layer 9 and the polishing layer 11 are inseparably attached to the damping layer 10 via a molding process during manufacturing of the polishing pad 8. An example for such a polishing pad 8 according to the present invention is shown in FIGS. 2 and 3. A further example for such a polishing pad 8 is shown in FIGS. 4 and 5 as well as in FIG. 6. The polishing pad 8 includes a plurality of through-holes 12 extending through the entire polishing pad 8 from and including the polishing layer 11 to and including the adhesive layer 9. Advantageously, each of the through-holes 12 has a longitudinal extension along a longitudinal axis 13 (see FIG. 5). The longitudinal axes 13 of the through-holes 12 preferably meet at a point of intersection 14 located in or near the center of the polishing pad 8, hence extending essentially radially. It is further advantageous that the longitudinal through-holes 12 have a curved form. Hence, the longitudinal axes 13 of the holes 12 have a curved form, too. The through-holes 12 serve as air intakes for cooling the polishing pad 8 and/or the machine tool 1 during operation. Furthermore, the provision of through-holes 12 in the polishing pad 8 reduces the area of the polishing layer's contact surface, with which the polishing layer 11 is in contact with the work piece's surface to be polished thereby reducing the friction surface, however, without reducing the polishing pad's effectiveness. The through-holes 12 have the advantage that they can receive large amounts of polishing liquid or paste and slowly dispense it to the surface to be polished during operation of the machine tool 1. Excess polishing liquid or paste on the surface to be polished can be easily and efficiently removed from the surface and received by the through-holes 12. The provision of the through-holes 12 in the polishing pad 8 reduce the contact surface between the adhesive layer 9 and the damping layer 10, as well as between the damping layer 10 and the polishing layer 11.

This affords a tight, resistible, and secure connection between the outer layers 9, 11 and the damping layer 10 located between the outer layers 9, 11.

Figure 6:
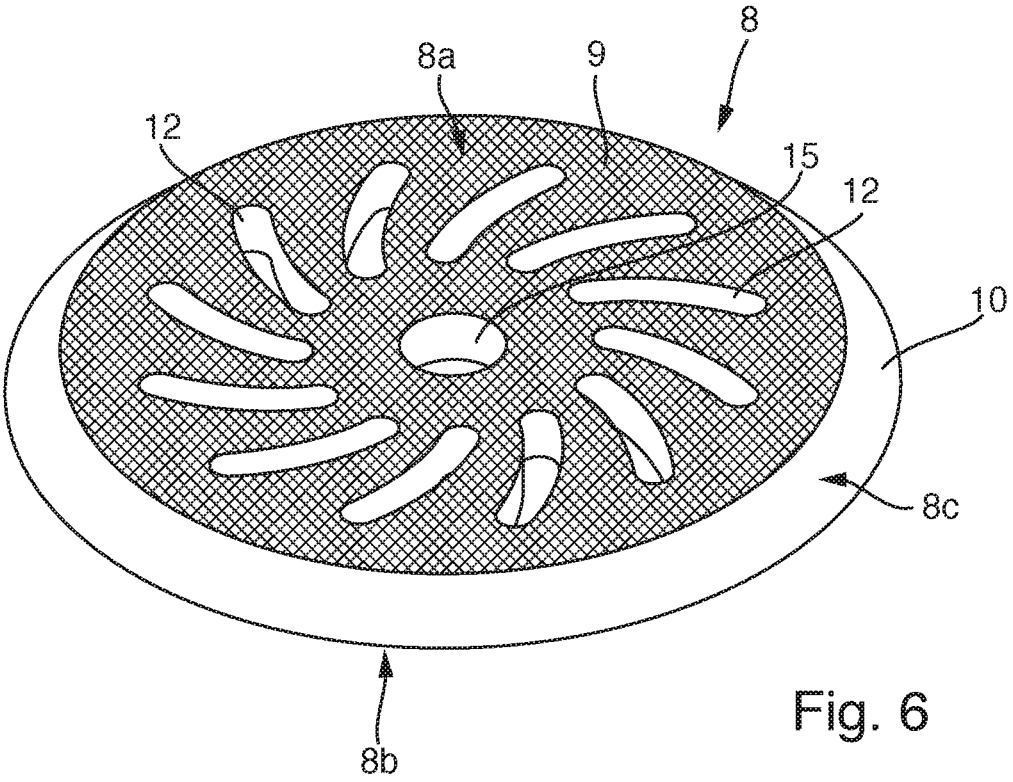
FIG. 6 is a perspective view of a polishing pad according to another embodiment of the invention.

Furthermore, the embodiments of FIGS. 4 to 6 have a central hole 15. The width of one or more of the through-holes 12 can vary along the holes' longitudinal axes 13. Further, it is possible that the width of the through-holes 12 varies from through-hole 12 to through-hole 12. The number of through-holes 12 can vary, depending, among others, on the diameter of the polishing pad 8. For example, the embodiment of FIGS. 4 and 5 may show a polishing pad 8 having a smaller diameter, for instance, of 100 mm or 120 mm, with only eight longitudinal through-holes 12. The embodiment of FIG. 6 may show a polishing pad 8 having a larger diameter, for instance, of 150 mm or 180 mm, with twelve longitudinal through-holes 12.

Figure 7:
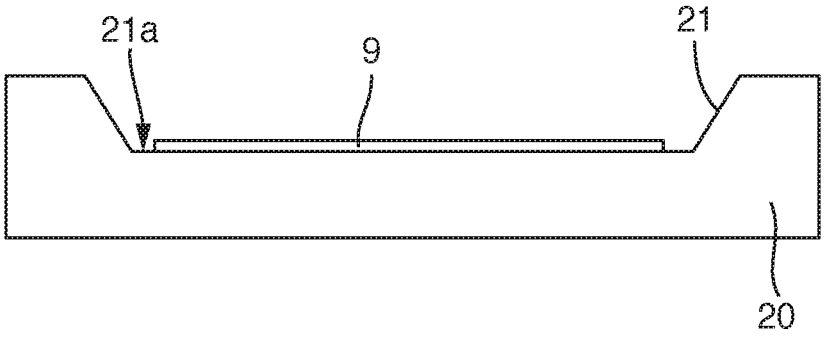
FIG. 7 shows one step of a method of manufacturing a polishing pad according to the present invention.
Figure 8:
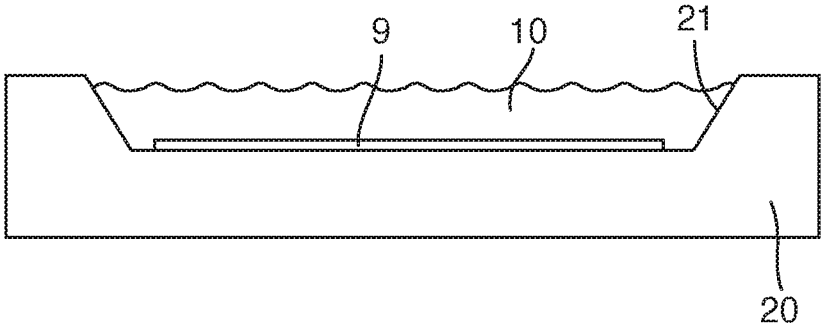
FIG. 8 shows another step of the method of manufacturing the polishing pad.

The process for manufacturing the polishing pad 8 according to the present invention is hereinafter described in more detail with reference to FIGS. 7 to 10. The manufacturing process starts by providing a casting mold 20 preferably made of a thermally conductive material, in particular metal. The casting mold 20 has a recess 21 which has a form essentially corresponding to the manufactured polishing pad 8. In a first step of the method, the adhesive layer 9 is placed face down at the bottom 21*a* of the recess 21 of the casting mold 20 (see FIG. 7). In this case, the term "face down" indicates that the active side of the adhesive layer 9 (the side with the hooks and/or loops of a hook-and-loop fastener layer) extends towards the bottom 21*a* of the recess 21. Then, the resilient material for the damping layer 10 is poured or injected into the recess 21 on top of the adhesive layer 9 (FIG. 8). The material can be poured into the recess 21 either because its compounds, of which at least one is fluid-like, semi-liquid, or viscous, have been combined shortly before pouring or injecting the material into the recess 21 and have not yet reacted and cured. Alternatively, the material can be poured or injected into the recess 21 because the material has been and possibly still is thermally treated, in particular heated, giving the material a fluid-like, semi-liquid, or viscous characteristic.

Figure 9:
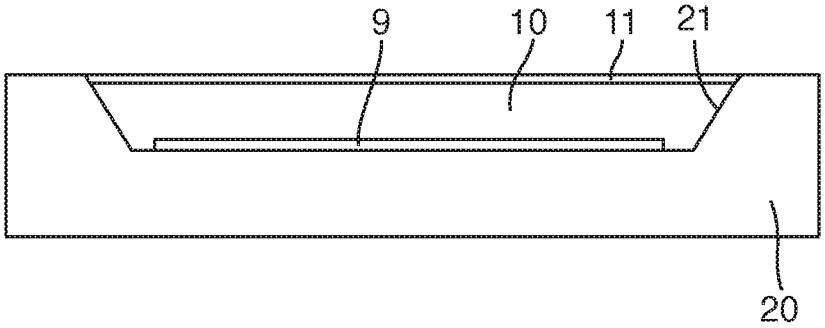
FIG. 9 shows another step of the method of manufacturing the polishing pad.
Figure 10:
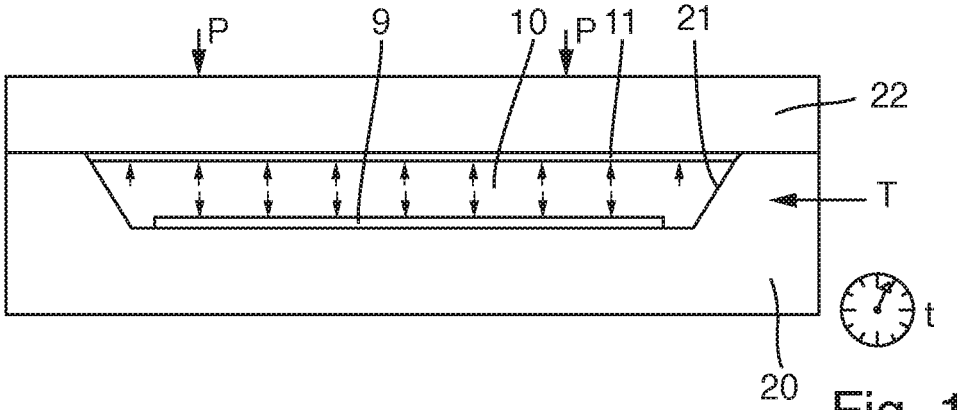
FIG. 10 shows another step of the method of manufacturing the polishing pad.

Next, the polishing layer 11 is placed face up on top of the resilient material of the damping layer 10 (FIG. 9). In this case, the term "face up" indicates that the active side of the polishing layer 1 (the side with the fibers of a polishing layer 11 made of microfiber) extends away from the bottom 21*a* of the recess 21. Finally, the recess 21 of the casting mold 20 is closed by placing a lid 22 on top of or in an opening of the recess 21 (FIG. 7). Advantageously, pressure p is applied to the lid 22 pressing it down towards the casting mold 20. Furthermore, a temperature T may be applied to the casting mold 20, to the recess 21 and in particular to the three layers 9, 10, 11 located therein. Next, the resilient material of the damping layer 10 has to cure for a certain time period t.

In one embodiment, the adhesive layer 9 and/or the polishing layer 11 may each include a fabric having a mesh with a predetermined tightness. The term "tightness" refers to the mutual distance between the fibers or threads of the mesh. By placing the lid 22 on the recess 2,1 a certain degree of pressure p is exerted on the three layers 9, 10, 11 located in the recess 21 of the casting mold. The adhesive layer 9 and the polishing layer 11 are pressed with their back faces into the still fluid-like, semi-liquid, or viscous resilient material of the damping layer 10, thereby urging some of the resilient material to enter at least partly into the mesh between the fibers or threads. This provides for an extremely strong connection between the adhesive layer 9 and the damping layer 10 on the one side and the polishing layer 11 and the damping layer 10 on the other side after the resilient material of the damping layer 10 has cured.

The mesh of the adhesive layer 9 and/or of the polishing layer 11 is preferably tight enough that is the mutual distance between the fibers or threads of the mesh is small enough to impede the resilient material of the damping layer 10 to pass through the fabric when poured into the recess 21 of the casting mold 20. In this way, no resilient material of the damping layer 10 reaches the front faces of the adhesive layer 9 and of the polishing layer 11. Such resilient material on the front face of the polishing layer 11 would severely affect the polishing capabilities of the entire polishing pad 8. On the other hand, resilient material reaching the front face of the adhesive layer 9 could affect a proper attachment of the polishing pad 8 to the bottom surface 7*a* of the working element 7. For example, the resilient material could enter into hooks or loops of the adhesive layer 9 thereby inactivating them so that they can no longer participate at the hook-and-loop connection between the adhesive layer 9 and a corresponding layer at the bottom surface 7*a* of the working element 7. However, the mesh of the adhesive layer 9 and/or of the polishing layer 11 is preferably loose enough that is the mutual distance between the fibers or threads of the mesh is large enough to allow the resilient material of the damping layer 10 to enter between the threads of the fabric when poured into the recess 21 of the casting mold 20. The tightness of the mesh of the adhesive layer 9 and/or of the polishing layer 11 is preferably selected depending on the fluidity or viscosity of the resilient material of the damping layer 10 when poured or injected into the recess 21, from the pressure p applied to the casting mold and other parameters, in order to achieve an optimum connection between the adhesive layer 9 and/or the polishing layer 11 and the damping layer 10, without excess resilient material entering onto the active sides of the adhesive layer 9 and/or the polishing layer 11.

The material of the damping layer 10 is preferably a polyurethane, in particular a semi-rigid polyurethane having microcells, for example like the material know from EP 0925317A1. Such a polyurethane material has a much better resistance against stress, load and wear applied to the polishing pad 8 during the polishing process. In particular, the material of the damping layer 10 is not so easily disintegrated as the conventional foamed material.

The polishing layer 11 could be placed on top of the resilient material of the damping layer 10 together with the lid 22. In that case, the polishing layer 11 would have to be previously attached to the inside of the lid 22. Then, when lowering the lid 22 onto the opening of the recess 21 thereby closing the casting mold 20 the polishing layer 11 is pressed with its back face into the resilient material of the damping layer 10.

It is also possible to initially place the polishing layer 11 face down at the bottom 21*a* of the recess 21 of the casting mold 20. Then, after the resilient material of the damping layer 10 has been poured or injected into the recess 21 on top of the polishing layer 11 the adhesive layer 9 could be placed face up on top of the resilient material of the damping layer 10. In that case, the adhesive layer 9 could be placed on top of the resilient material together with the lid 22, in which case the adhesive layer 9 is previously attached to the lid 22.

The amount of the resilient material of the damping layer 10 poured into the recess 21 (FIG. 8) is defined such that the resilient material together with the adhesive layer 9 and the polishing layer 11, in any event, completely fills out the recess 21 when closed with the lid 22. Preferably, the amount of resilient material is slightly more than actually needed for filling out the recess 21, in order to make sure that, in any event, the recess 21 is completely filled out with the adhesive layer 9, the polishing layer 11, and the damping layer 10. The superfluous resilient material could be squeezed out of the casting mold 20 when the lid 22 is pressed onto or into the recess 21.

The casting mold 20 and possibly also the lid 22 may be made of a thermally conductive material, in particular of metal. The casting mold 20 and possibly the lid 22 are heated (FIG. 7) in order to convey at least part of the applied heat T to the recess 21 and the layers 9, 10, 11 located therein during manufacturing of the polishing pad 8. By applying a defined amount of heat T over time t under a certain pressure p, the curing of the resilient material of the damping layer 10 can be controlled in order to give the damping layer 10 the desired characteristics.

The recess 21 preferably has a truncated cone shape. The slanting side walls of the recess 21 serve for forming a peripheral surface 8*c* of the polishing pad 8, the surface 8*c* connecting the top surface 8*a* and the bottom surface 8*b*. In a cross sectional view (see FIGS. 7 to 10) the side walls of the recess 21 can be formed planar (like in FIGS. 7 to 10) or arcuated or curved. The angle of the side walls of the recess 21 is within a range of 15° to 70°. Hence, the polishing pad 8 manufactured by the casting mold 20 shown in FIGS. 7 to 10 has a truncated cone shape, too, corresponding to the form of the recess 21. One advantage of the truncated form is that the manufactured polishing pad 8 can be easily extracted from the recess 21 at the end of the manufacturing process, because the recess 21 has no undercuts. Furthermore, due to the reduced thickness of the polishing pad 8 along its external rim, the external rim is particularly resilient allowing it to easily follow the surface to be polished in edges and angles.

Advantageously, the surface 8*a* which the adhesive layer 9 is attached to has a smaller diameter than the surface 8*b* which the polishing layer 11 is attached to. Furthermore, the adhesive layer 9 can have a smaller diameter than the surface 8*a* it is attached to. Moreover, the polishing layer 11 can have a diameter at least the size of the diameter of the surface 8*b* it is attached to. With the polishing layer 11 slightly extending beyond the circumference of the surface 8*b* it can be assured that the polishing layer 11 remains in contact with the surface to be polished even in edges and angles. Hence, it is avoided that in edges or angles the damping layer 10 comes into contact with the surface to the polished.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A polishing pad for a hand guided electric or pneumatic polishing machine tool having a working element performing an orbital, random orbital or a rotational movement, the polishing pad having a plurality of layers attached to one another including:

a damping layer made of a resilient material including expanded semi-rigid polyurethane having a microcell structure;

an adhesive layer including a layer of a hook-and-loop fastener adapted to interact and connect to a corresponding layer of the hook-and-loop fastener located at a bottom surface of the working element of the machine tool; and a polishing layer including microfibers adapted for polishing a surface of a work piece, wherein said damping layer, said adhesive layer and said polishing layer combine to form said polishing pad and wherein the polishing layer includes a fabric having a woven mesh of fibers or threads that define a back side of the polishing layer, said fabric being so tightly woven as to serve as a barrier to the resilient material of the damping layer such that the resilient material does not reach an active side of the polishing layer comprising the microfibers when said damping layer, adhesive layer and said polishing layer are combined, and such that the active side of the polishing layer of the polishing pad is free of resilient material of the damping layer.

2. The polishing pad as set forth in claim 1, wherein the adhesive layer includes a layer of loops adapted to interact with a layer of hooks located at the bottom surface of the working element.

3. The polishing pad as set forth in claim 1, wherein the microfibers are hydrophobic.

4. The polishing pad as set forth in claim 1, wherein the polishing pad has the form of a truncated cone.

5. The polishing pad as set forth in claim 4, wherein a top surface of the polishing pad carrying the adhesive layer has a smaller diameter than a bottom surface of the polishing pad carrying the polishing layer.

6. The polishing pad as set forth in claim 5, wherein the polishing pad has a peripheral surface connecting the top surface and the bottom surface, the peripheral surface having an angle in respect to the bottom surface within a range of 15° to 70° and being planar or curved to the inside or the outside.

7. The polishing pad as set forth in claim 1, wherein the polishing pad includes a plurality of through-holes extending through the entire polishing pad from and including the polishing layer to and including the adhesive layer, each of the through-holes having a longitudinal extension with a curved form and extending radially.

8. The polishing pad as set forth in claim 1, wherein the adhesive layer includes a fabric having a woven mesh that acts as a barrier to the resilient material of the damping layer such that the resilient material does not reach an active side of the adhesive layer.

* * * * *